US011766099B2

(12) United States Patent
Russel

(10) Patent No.: US 11,766,099 B2
(45) Date of Patent: Sep. 26, 2023

(54) WEDDING RING NECKLACE PENDANT

(71) Applicant: Jean Russel, Marietta, GA (US)

(72) Inventor: Jean Russel, Marietta, GA (US)

( * ) Notice: Subject to any disclaimer, the term of this patent is extended or adjusted under 35 U.S.C. 154(b) by 113 days.

(21) Appl. No.: 17/474,991

(22) Filed: Sep. 14, 2021

(65) Prior Publication Data

US 2023/0079564 A1 Mar. 16, 2023

(51) Int. Cl.
*A44C 15/00* (2006.01)
*A44C 25/00* (2006.01)
*A44C 9/00* (2006.01)

(52) U.S. Cl.
CPC ..... *A44C 15/0055* (2013.01); *A44C 9/0084* (2013.01); *A44C 25/001* (2013.01)

(58) Field of Classification Search
CPC ..... A44C 9/0084; A44C 25/001; A44C 25/00; A44C 25/007; A44C 7/002; A44C 15/001; A44C 15/003; A44C 15/005; A44C 15/0055; A44C 25/002
USPC ..... 63/21, 23; 206/6.1, 348; D11/6, 7
See application file for complete search history.

(56) References Cited

U.S. PATENT DOCUMENTS 686,197 A * 11/1901 Bippart ..... A44C 15/001 63/23
1,141,992 A * 6/1915 Toelcke ..... A44C 15/003 63/29.1
2019/0191830 A1* 6/2019 Ruiz ..... A44C 25/001

* cited by examiner

*Primary Examiner* — Jack W Lavinder
(74) *Attorney, Agent, or Firm* — Lyman Moulton, Esq.; Moulton Patents, PLLC

(57) ABSTRACT

The disclosed wedding ring necklace pendant includes the necklace, a retainer ring, the wedding ring the ring holder pendant, the pendant attachments, the retaining rod and the retaining rod rings. The retainer ring rotates 360 degrees to accommodate a flat and a perpendicular orientation to a wearer's chest. The retaining rod slides in and out of the retaining rod rings to hold the wedding ring between the retaining rod rings. A love bird pendant is slidingly attached to the necklace to move along its length. The love bird pendant is also attached to the necklace permanently and semi-permanently via crimped pendant attachments. Other ornamental designs include two heart halves, the letters "LOVE," and other romantic and endearing symbols and words. Various designs also prevent an escape of the wedding ring from the pendant retainers including multiple loop retainers, hinges, rod bumps and enlargements.

8 Claims, 4 Drawing Sheets

WEDDING RING NECKLACE PENDANT

BACKGROUND

A necklace is an ornamental article of jewelry that is worn around the neck of various lengths and sizes. Necklaces may have been one of the earliest types of adornment worn by humans. They often serve ceremonial, religious, magical, or funerary purposes and are also used as symbols of wealth and status, given that they are commonly made of precious metals and stones.

The main component of a necklace is the band, chain, or cord that wraps around the neck. These are most often rendered in precious metals such as gold, silver, and platinum. Necklaces often have additional attachments suspended or inserted into the necklace itself. These attachments typically include pendants, lockets, amulets, crosses, and precious and semi-precious materials such as diamond, pearls, rubies, emeralds, garnets, and sapphires. They are made with many different type of materials and are used for many things.

SUMMARY OF THE INVENTION

The disclosed wedding ring necklace pendant includes the necklace, a retainer ring, the wedding ring the ring holder pendant, the pendant attachments, the retaining rod and the retaining rod rings. The retainer ring rotates 360 degrees to accommodate a flat and a perpendicular orientation to a wearer's chest. The retaining rod slides in and out of the retaining rod rings to hold the wedding ring between the retaining rod rings.

A love bird pendant is slidingly attached to the necklace to move along its length. The love bird pendant is also attached to the necklace permanently and semi-permanently via crimped pendant attachments. Other ornamental designs include two heart halves, the letters "LOVE," and other romantic and endearing symbols and words. Various designs also prevent an escape of the wedding ring from the pendant retainers including multiple loop retainers, hinges and rod bumps and enlargements.

Figure 1:
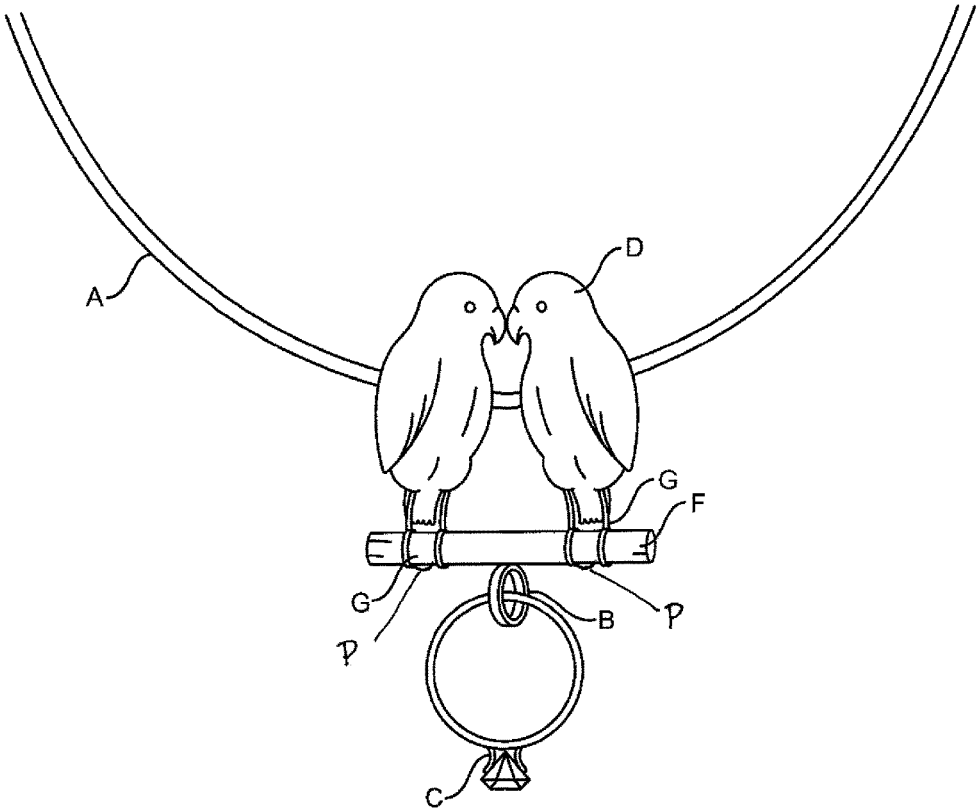
FIG. 1 depicts a front perspective view of a retaining rod and loop wedding ring necklace pendant in accordance with an embodiment of the present disclosure.

Throughout the description, similar reference numbers may be used to identify similar elements depicted in multiple embodiments. Although specific embodiments of the invention have been described and illustrated, the invention is not to be limited to the specific forms or arrangements of parts so described and illustrated. The scope of the invention is to be defined by the claims appended hereto and their equivalents.

DETAILED DESCRIPTION

Reference will now be made to exemplary embodiments illustrated in the drawings and specific language will be used herein to describe the same. It will nevertheless be understood that no limitation of the scope of the disclosure is thereby intended. Alterations and further modifications of the inventive features illustrated herein and additional applications of the principles of the inventions as illustrated herein, which would occur to one skilled in the relevant art and having possession of this disclosure, are to be considered within the scope of the invention.

Throughout the present disclosure the term 'pendant' refers to a piece of jewelry for retaining a wedding ring that hangs from a chain worn around the neck. The term, 'hinged,' refers to an ability to swing, move into and rotate to complete an attachment.

FIG. 1 depicts a front perspective view of a retaining rod and loop wedding ring necklace pendant in accordance with an embodiment of the present disclosure. The depiction includes the necklace A, a retainer ring B, the wedding ring C the ring holder pendant D, the pendant attachments E, the retaining rod F, the retaining rod rings G and the bumps, enlargements or catches P. The retainer ring B rotates 360 degrees to accommodate a flat and a perpendicular orientation to a wearer's chest. The retaining rod F slides in and out of the retaining rod rings G to hold the wedding ring between the retaining rod rings. Catches, bumps or enlargements P on the retaining rod hold it in place and prevent it from sliding out of the retaining rod rings. The retainer ring B also comprises a double or multiple loop design not unlike a key chain loop so to facilitate removal and reattachment of a wedding ring thereto.

Figure 2:
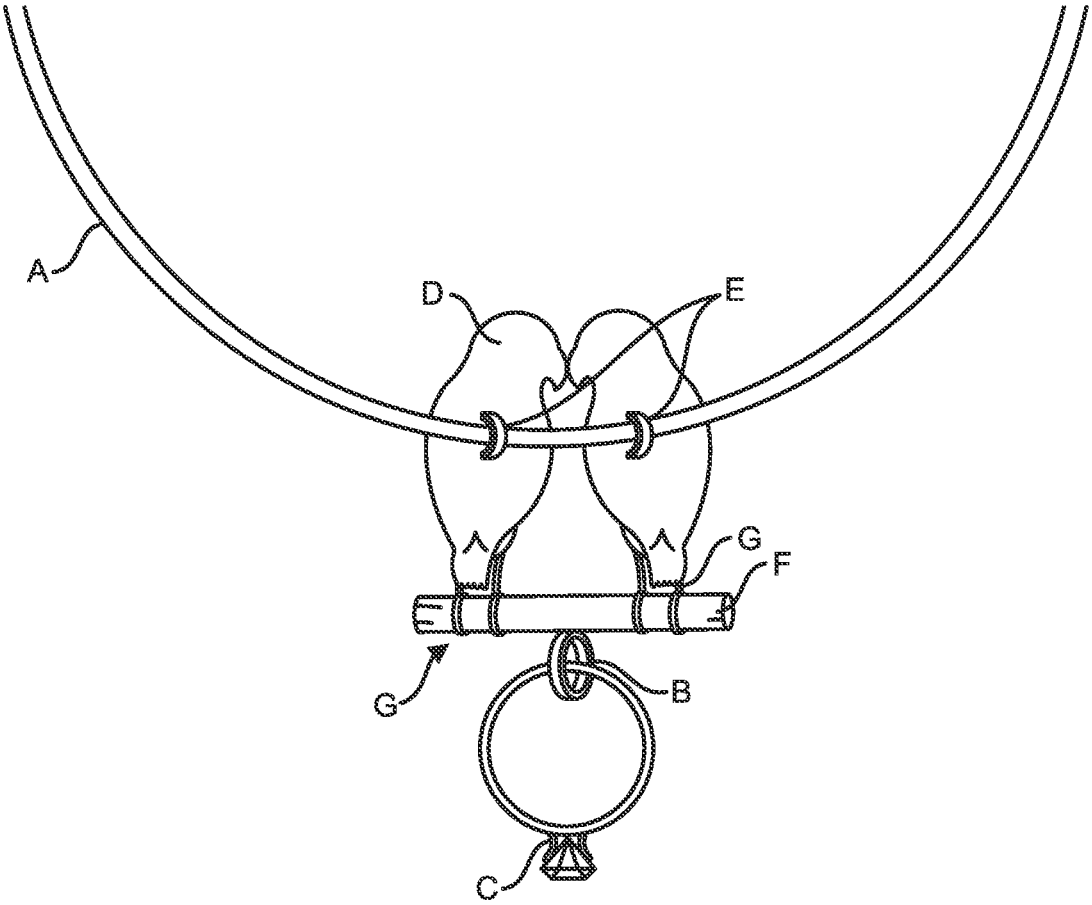
FIG. 2 depicts a back perspective view of the retaining rod and loop wedding ring necklace pendant in accordance with an embodiment of the present invention.

FIG. 2 depicts a back perspective view of the retaining rod and loop wedding ring necklace pendant in accordance with an embodiment of the present invention. The depiction includes the necklace A, a retainer ring B, the wedding ring C the ring holder pendant D, the pendant attachments E, the retaining rod F and the retaining rod rings G. The love bird pendant depicted is slidingly attached to the necklace to move along its length. The love bird pendant is also attached to the necklace permanently and semi-permanently via crimped pendant attachments. Other ornamental designs include two heart halves, the letters "LOVE," and other romantic and endearing symbols and words.

Figure 3:
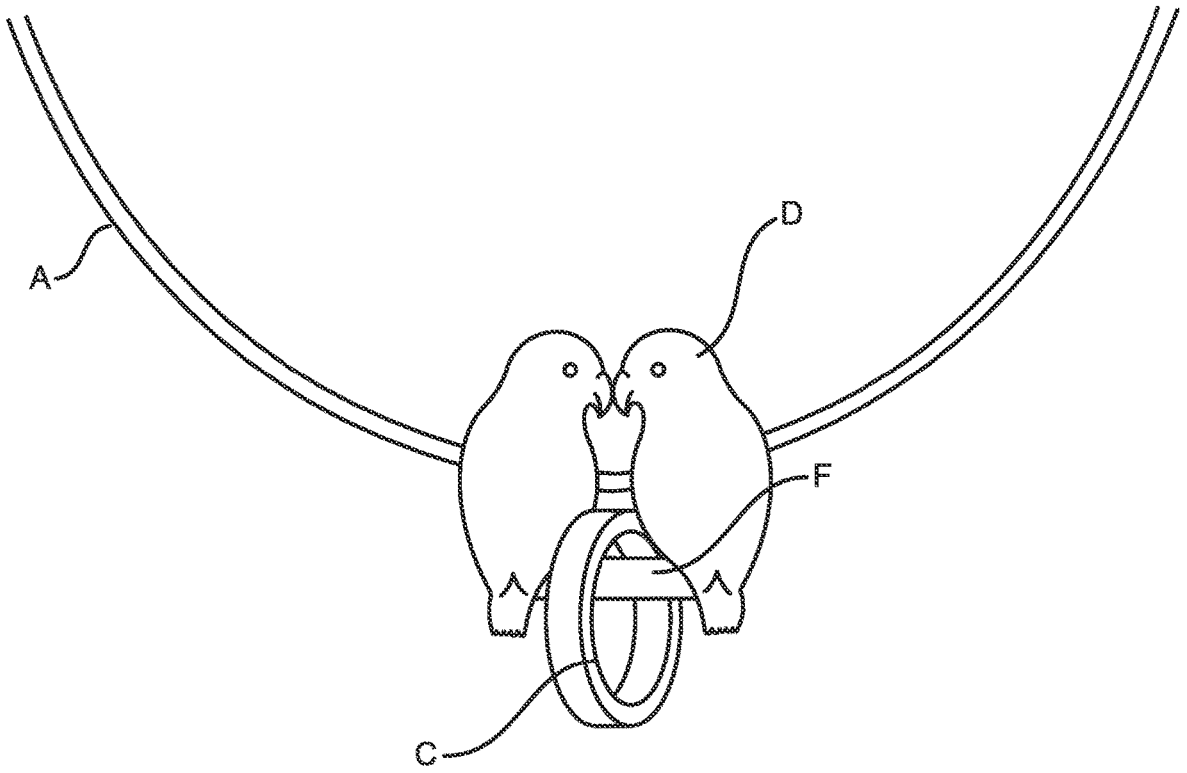
FIG. 3 depicts a front perspective view of a hinged holder wedding ring necklace pendant in accordance with an embodiment of the present disclosure.

FIG. 3 depicts a front perspective view of a hinged holder wedding ring necklace pendant in accordance with an embodiment of the present disclosure. The depiction includes similar and same reference letters and lines of other figures with the addition of a hinge H and a lock ring J.

Figure 4:
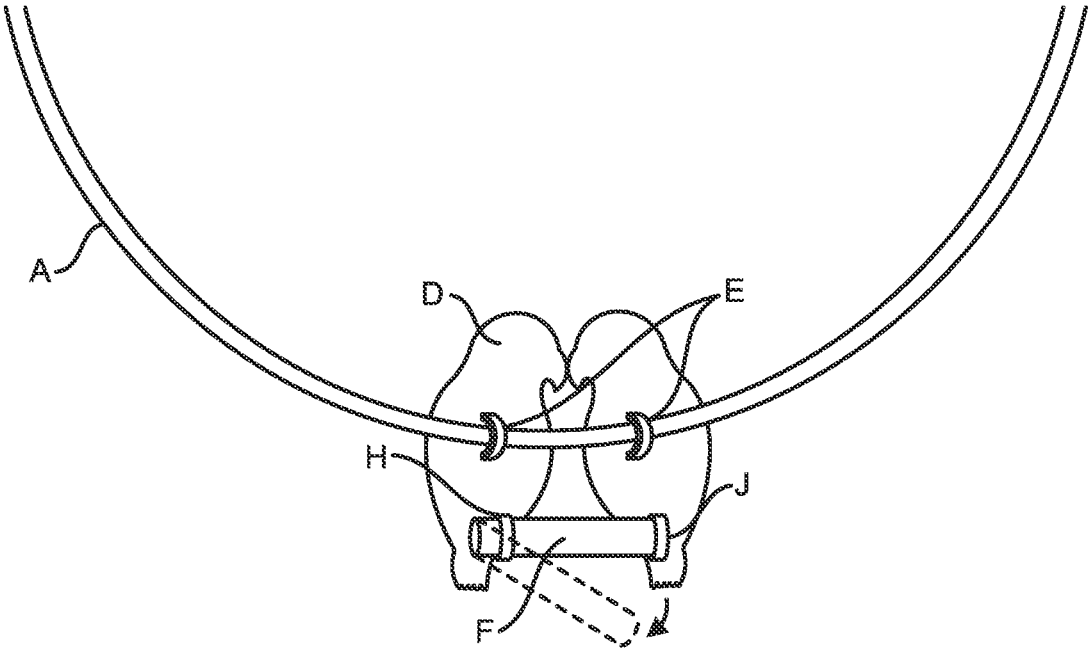
FIG. 4 depicts a back perspective view of the hinged holder wedding ring necklace pendant in accordance with an embodiment of the present disclosure.

FIG. 4 depicts a back perspective view of the hinged holder wedding ring necklace pendant in accordance with an embodiment of the present disclosure. The depiction includes similar and same reference letters and lines of other figures with the addition of a hinge H and a lock ring J. The retaining rod F moves into a locked position with the lock ring J via rotating about the hinge H and sliding into the lock ring J.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

While the forgoing examples are illustrative of the principles of the present disclosure in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the disclosure be limited, except as by the specification and claims set forth herein in a non-provisional specification to follow.

What is claimed is:

1. A necklace pendant comprising a ring holder pendant attached to the necklace;

a retaining rod attached to the ring holder pendant; and a retaining rod ring attached to the retaining rod, wherein the retaining rod is slidably attached to the ring holder pendant via multiple loop retainers on the ring holder pendant and bumps and enlargements on the retaining rod.

2. The necklace pendant of claim 1, wherein the ring holder pendant resembles two love birds attached side by side to each other and each attached to the necklace.

3. The necklace pendant of claim 1, wherein the ring holder pendant is slidingly attached to the necklace to move along its length.

4. The necklace pendant of claim 1, wherein the retaining rod ring rotates 360 degrees to accommodate a flat and a perpendicular orientation to a wearer's chest.

5. The necklace pendant of claim 1, wherein the ring holder pendant attaches to the necklace permanently and semi-permanently via crimped pendant attachments.

6. The necklace pendant of claim 1, wherein the retaining rod is attached to the ring holder pendant via a hinge.

7. The necklace pendant of claim 1, wherein the retaining rod is attached to the ring holder pendant via multiple loop retainers.

8. The necklace pendant of claim 1, wherein the retaining rod slides in and out of the ring holder pendant to receive a wedding ring there around.

* * * * *